United States Patent [19]

Quinlan, Jr.

[11] Patent Number: 4,845,994

[45] Date of Patent: Jul. 11, 1989

[54] COIN TESTING APPARATUS

[75] Inventor: Thomas J. Quinlan, Jr., Beach Haven Terrace, N.J.

[73] Assignee: Automatic Toll Systems, Inc., Teterboro, N.J.

[21] Appl. No.: 229,841

[22] Filed: Aug. 8, 1988

Related U.S. Application Data

[63] Continuation-in-part of Ser. No. 162,190, Feb. 29, 1988.

[51] Int. Cl.[4] ..... G07F 3/02

[52] U.S. Cl. ..... 73/163; 194/317; 194/318

[58] Field of Search ..... 73/163; 194/317, 318

[56] References Cited

U.S. PATENT DOCUMENTS

| | | | |
|---|---|---|---|
| 4,184,366 | 1/1980 | Butler | 73/163 |
| 4,334,604 | 6/1982 | Davies | 73/163 |
| 4,471,864 | 9/1984 | Marshall | 73/163 |
| 4,572,349 | 2/1986 | Funya et al. | 194/318 |
| 4,666,027 | 5/1987 | Ostroski et al. | 194/318 |
| 4,705,154 | 11/1987 | Musho et al. | 194/318 |
| 4,749,074 | 6/1988 | Veki et al. | 73/163 |

FOREIGN PATENT DOCUMENTS

| | | | |
|---|---|---|---|
| 8303154 | 9/1983 | European Pat. Off. | 73/163 |

OTHER PUBLICATIONS

Hewlett Packard HCTL-2000; Jan. 1986.
Analog Devices AD1170; 9/86.
Analog Devices AD521.
Analog Devices AD536A.

*Primary Examiner*—William A. Cuchlinski, Jr.
*Assistant Examiner*—Diego F. F. Gutierrez
*Attorney, Agent, or Firm*—Lee C. Robinson, Jr.

[57] ABSTRACT

An apparatus for testing a coin provides first, second, and third digital signals respectively indicative of the coin's metallic content, diameter, and thickness. A microprocessor-based control circuit identifies the coin as being one of a number of known coins in response to the digital signals. If the coin does not match any of the known coins, it is identified as a false coin, for example, a slug or foreign money.

15 Claims, 4 Drawing Sheets

COIN TESTING APPARATUS

RELATED APPLICATION

This application is a continuation-in-part of applicant's copending application Ser. No. 07/162,190, filed Feb. 29, 1988.

FIELD OF THE INVENTION

This invention relates to the field of electronic circuits which are used to distinguish between genuine and counterfeit coins. More particularly it relates to coin testing circuits particularly well adapted for use in high speed automatic toll collecting systems on roadways.

BACKGROUND OF THE INVENTION

Distinguishing automatically between genuine U.S. coins and other objects such as foreign coins, counterfeit coins, and metallic slugs is of great importance in devices such as coin operated vending machines and automatic toll booths, as well as in many other, similar devices.

Many methods have been suggested to accomplish the task of distinguishing genuine coins from counterfeit ones. A number of these methods rely on purely mechanical devices which both weigh the coin and measure its physical dimensions. Such devices generally operate relatively slowly, which may be a problem if the device is required to operate in a high-volume, high speed area. Additionally, the capability of such devices to detect well made counterfeits is limited. Finally, a mechanical device, due to size limitations and relative mechanical complexity, can only operate upon and distinguish between counterfeit and genuine coins for a limited number of coin types.

Various electrical methods have also been suggested to distinguish between counterfeit and genuine coins. Many of these involve the use of an inductive coil which forms part of an electromagnetic "tank" circuit. When a metallic coin-shaped object passes through the magnetic field of the inductive coil, the inductance and hence the circuit's resonance changes, depending upon coin size, composition and magnetic permeability. These changes can be detected by "ringing" (periodically applying a voltage to the circuit) the resonant circuit when a coin-like object is present to produce a damped resonant waveform output. A comparison between the resultant decaying waveform in frequency and/or decay characteristics with stored values for genuine coins allows the circuit to distinguish the genuine coins from the counterfeit.

Existing counterfeit coin detector circuits have several problems. The first is that the sensing circuit is generally quite susceptible to variations in temperature. Thus, as temperature changes, genuine coins may be determined to be counterfeit, or counterfeit coins may go undetected. This is a particular problem in coin detectors which must Operate in an Outdoor environment, such as automatic toll collecting systems for roadways.

Another problem is that most counterfeit coin detector circuits can only validate a limited number of different types of coins. In an area adjacent to a national border, where two different sets of coins may appear relatively frequently, this limitation can be quite troublesome. Finally, the purely analog nature of these circuits requires relatively frequent calibration over the lifetime of the circuit, not merely to correct the effects of temperature changes, but also to compensate for wear on the mechanical portions of the equipment, humidity, etc.

Thus, there is a need for a counterfeit coin detector circuit which can validate many different types of coins, which can operate very rapidly with a very low error rate in a relatively harsh, outdoor environment, that is simple and rugged, which requires very little, if any, calibration and which is highly temperature independent.

OBJECTS OF THE INVENTION

It is an object of this invention to provide a coin testing circuit which can rapidly and accurately distinguish between many different types of coins and their counterfeit imitations.

It is another object of this invention to provide a coin testing circuit which can be retrofitted into standard toll collecting systems.

Yet another object of this invention is to provide a coin testing circuit which is extremely rugged and which can be capable of continuous, trouble-free operation under stressful environmental conditions.

It is another object of this invention to provide a coin testing circuit which can be driven at a precisely controlled and constant frequency and amplitude.

Still another object of this invention is to distinguish coins and counterfeit objects using a digital logical circuit.

Yet another object of this invention is to provide a coin testing circuit which will require little, if any, calibration during its operational lifetime.

Still another object of the invention is to provide a coin testing circuit which can be easily adjusted to distinguish between different types of coins than the circuit was originally set to detect.

SUMMARY OF THE INVENTION

In accordance with an aspect of the present invention, apparatus for testing a coin having a metallic content, a diameter and a thickness comprises a first source of a first digital signal having a value indicative of a metallic content of a coin, a second source of a second digital signal having a value indicative of a diameter of the coin, a third source of a third digital signal having a value indicative of a thickness of the coin, and microprocessor-based control means for identifying the coin as being one of a plurality of known coins in response to the first, second and third digital signals. In one embodiment, the control means includes algorithm evaluation means for evaluating a coin identifying algorithm in response to the first, second and third digital signals. In another embodiment, the control means includes memory means for storing a plurality of digital windows each being respectively indicative of a range of metallic content values, diameter values or double-dime thickness for respective ones of the known coins, and the control means further includes means for determining which of the windows includes the values of the first, second and third digital signals, respectively.

These and other objects, features and advantages of the invention will be apparent from the following detailed description of preferred embodiments thereof taken in connection with the accompanying drawings, throughout which like reference numerals denote like elements and parts.

DETAILED DESCRIPTION OF THE PREFERRED EMBODIMENTS

Figure 1:
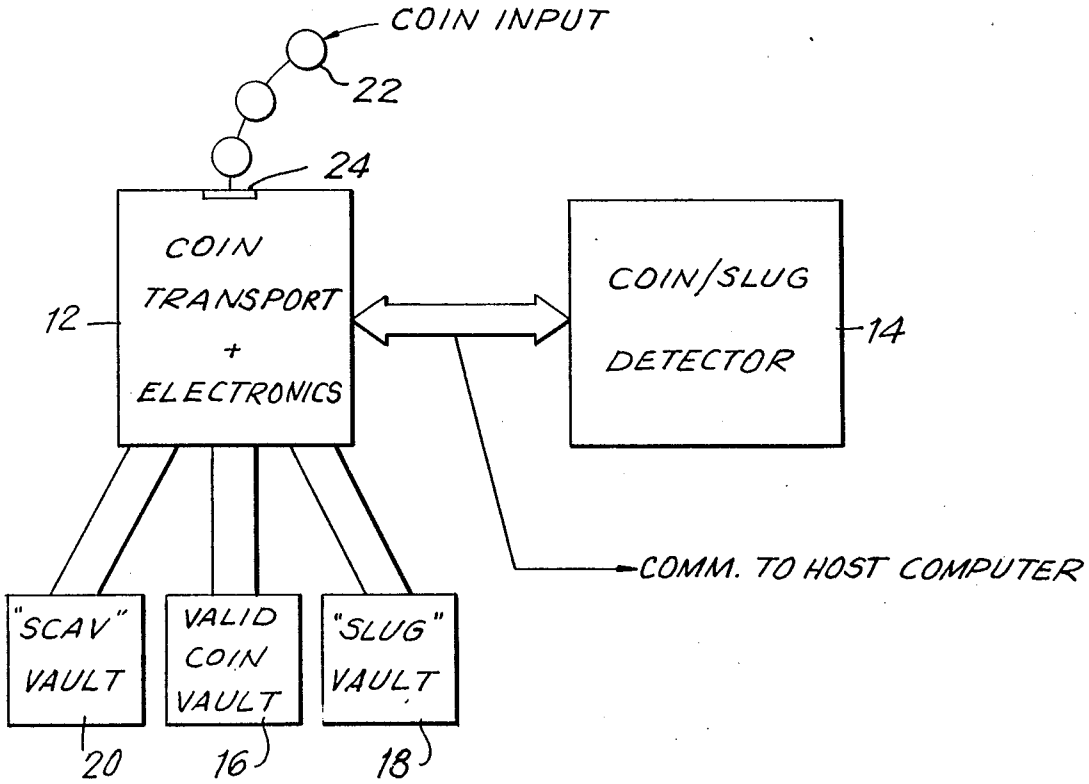
FIG. 1 is a functional drawing of a coin testing apparatus according to the present invention.

Referring now to the drawings, and initially to FIG. 1 thereof, the coin testing apparatus in accordance with the present invention includes a coin transport/electronics section 12, a coin/slug detector 14 and three depository vaults 16, 18 and 20 for holding various ones of the deposited items 22. In the method and apparatus in accordance with the present invention described below, each deposited item is identifiable as a monetary coin of known characteristics, a slug of known characteristics or neither of the two. Because certain slugs or tokens are of known structure and metallic content and are acceptable in certain coin collecting systems, the term "coins" as used below in the present application will refer both to what is commonly thought of as a coin, that is, a metal piece of money, as well as metal slugs, metal tokens and the like, unless an express distinction is made.

As schematically indicated in FIG. 1, a coin input 24 consisting of a slot, receptacle or the like receives the coins 22 deposited by the user. Transport/electronics section 12 receives the deposited coins 22 and transports them to operative positions therein for the detection of predefined characteristics. It will be understood that these predefined characteristics correspond to coins of known composition and structure, hereinafter referred to as known coins, for example nickels, dimes and quarters. Transport/electronics section 12 stores the coins 22 in one of the three vaults 16, 18 and 20. Vault 16 will receive all items identified as valid monetary coins, vault 18 will receive all items identified as slugs, and vault 20 will receive all other deposited items.

The purpose of the present invention is to accurately determine when the deposited coin corresponds to a known coin. The system may be intended to accept either a monetary coin or a slug as a valid input if this item has been selected as a known coin for the system. The present invention is not directed to the structure or operation of transport/electronics section 12 in receiving the coins 22, moving them to the various operative positions for detection or to the deposition of the coins 22 in one of the vaults 16, 18 and 20. Such structure and operation are well known and will not be described herein. Instead, the present invention is directed to the structure and operation of coin/slug detector 14 and the associated electronics within transport/electronics section 12 whereby a deposited coin may be accurately discriminated as one of the selected known coins.

One advantageous feature of coin testing apparatus is its ability to sense the metallic content of a coin. The discrimination between silver, nickel and other metals used in common coins provides one identifying feature for the coin. Indeed, were it not for the possibility of slugs, the metallic content alone would probably be sufficient to discriminate between the known coins of a particular monetary system.

Figure 2:
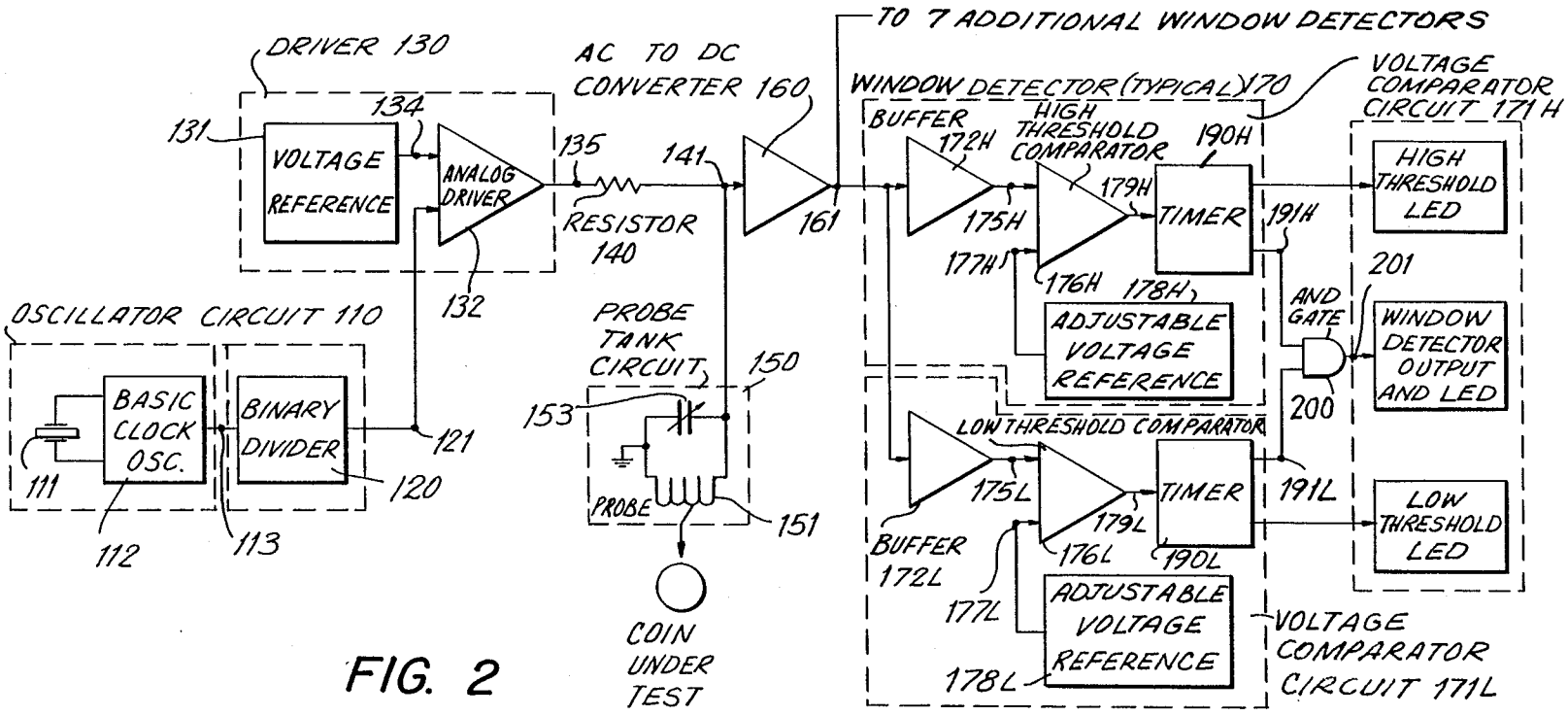
FIG. 2 is a schematic block diagram of a preferred embodiment of the present invention, including a metallic content detector and analog window detector usable in the apparatus of FIG. 1.

Referring now to FIG. 2, a first embodiment of a counterfeit coin detector circuit is depicted in schematic form. This circuit includes oscillator circuit 110, which is adapted to provide a sinusoidal wave with constant amplitude and frequency. Oscillator circuit 110 is preferably constructed of an oscillator 112 controlled by a quartz crystal 111, or other stable, high frequency oscillators. Such a circuit is known to the art and can be constructed from either discrete components or from integrated circuits.

In this first embodiment of the present invention, oscillator circuit 110 preferably provides a sinusoidal wave output with a frequency of 2.45 MHz at the output 113. The exact frequency used is not critical as long as it remains very stable and is of sufficiently high frequency to avoid degradation by low frequency AC noise.

A binary divider 120 is connected to the output 113 of oscillator circuit 110. Binary divider circuit 120 is adapted to convert the high frequency sinusoidal wave produced by oscillator 110 into a square wave with a 50% duty cycle at output 121. In the first embodiment, the binary divider includes a frequency divider such as a 14040 frequency divider integrated circuit chip, available commercially from Motorola Corp. The chip produces an output frequency of 19.2 KHz and a voltage swing of 0 to 12 volts. Frequency divider circuits are conventional and well known in the art. In this embodiment of the present invention, the voltage output of the frequency divider is then input to a comparator circuit of conventional design (not shown) which is adapted to shift the voltage level of the square wave provided by frequency divider from 0V/+12 V to +12 V/−12V at the output 121 of the binary divider 120.

The counterfeit coin detector circuit of the present invention also includes a driver circuit 130 for the tank circuit. Driver 130 includes a voltage reference 131 and an analog driver or amplifier 132. The analog driver 132 has a first input coupled to the output 121 of the binary divider and a second input coupled to an output 134 of the voltage reference 131.

Voltage reference 131 should be stable and relatively free of influence of temperature. Such stable voltage references can be constructed of conventional components and are of well known construction. In the present invention, an MC1504 voltage reference outputting through an adjustable voltage divider network is used. The adjustable resistor network permits precise adjustment of the output voltage to the desired value during calibration. Once the output voltage is calibrated, the output voltage of the voltage reference circuit 131 at output 134 will be stable and very independent of changes due to temperature.

The analog driver 132 combines the output 121 from the binary divider circuit 120 with the precisely controlled and stable voltage output 134 from the voltage reference 131 to produce a square wave AC output at 135 of 50% duty cycle having a stable maximum and minimum voltage and equal positive and negative deflection controlled by the voltage output 134 from the voltage reference 131. In a preferred embodiment of the present invention, the output voltage from the analog driver is ±6.4 V, but other voltages can also be employed.

The coin testing circuit of the present invention also includes a probe tank circuit 150, which includes an inductor probe 151 connected in parallel to an adjustable capacitor circuit 153. Inductor probe 151 is positioned to magnetically interact with the coin under test. Since the overall inductance of inductor probe/coin combination is affected by the size, composition and magnetic permeability of the coin under test, the overall inductance of the probe/coin is a unique function of the characteristics of the coin under test.

Adjustable capacitor circuit 153 is preferably a bank of fixed capacitance capacitors switchably connected in parallel to one another. During calibration of the coin testing circuit, various capacitors can be connected or disconnected until the desired overall capacitance appropriate for the coins to be tested is obtained. By selectively placing any one or a combination of several of its capacitors in parallel with the probe, the proper resonant frequency of the probe circuit can be established. The capacitance should be adjusted so that the natural resonant frequency of the probe tank circuit is close to the frequency of the output from the analog driver 132.

To differentiate the stable, fixed frequency, constant maxima and minima voltage square wave output 135 from the analog driver 132 from the fixed frequency, but variable voltage output from the probe tank circuit, a resistor 140, preferably having a resistance in the range of 15K ohms, is interposed between output 135 and output 141. Since inductor probe 151 of the probe tank circuit 150 has an inherent internal resistance, inductor 151 functions as one resistor of a voltage divider network which includes resistor 140 to divide the voltage at 135 in proportion to the resistance of resistor 141 and the resistance of the inductor 151.

Since the probe tank circuit is forceably driven at a fixed frequency, the output frequency of the signal at 141 will be the same frequency as the frequency of the signal at 135. However, the amplitude of the voltage output at 141 from the tank circuit 150 will vary depending upon the overall inductance of the tank circuit which, in turn, is a unique function of the characteristics of the coin under test.

The voltage output at 141 of the probe tank circuit is input to a circuit 160 adapted to convert the AC output of the probe tank circuit to a DC signal at output 161 which is correlated in amplitude to the peak to peak amplitude of the AC signal at 141. In the preferred embodiment of the present invention, a charge-coupled precision DC rectifier is used as circuit 160, which is commercially available from a number of sources. Alternatively, a root mean square converter circuit can be employed. By "correlated" is meant that the DC output at 161 is a unique function of the peak to peak amplitude of the signal at 141. It is not necessary, however, that the DC voltage at 161 b equal to the peak to peak voltage amplitude at 141 or even linearly proportional to it. It is only necessary that the DC output at 161 be a unique function of the AC output at 141. Because the AC output at 141 is a unique function of the characteristics of the coin under test, the value of the DC output at 161 will be a unique function of the characteristics of the coin under test.

In this embodiment, also disclosed in applicant's above-referenced copending application, the DC output at 161 is input to a plurality of window detector circuits 170 connected in parallel to one another. Each of the window detector circuits includes a low threshold comparator adapted to provide a signal when the DC signal at 161 is greater than a minimum preset reference voltage value and a high threshold comparator adapted to provide a signal when the voltage is less than a preset maximum reference voltage value. The maximum and minimum voltage values for each window detector are set during calibration to correspond to the presence of a coin of a particular type at the inductor probe 151. In the present example, eight window detector circuits are employed, corresponding to eight different coin types to be differentiated. The construction of all the window detector circuits is essentially the same, differing only in the values of the reference voltages set during calibration.

Each window detector 170 includes two voltage comparator circuits 171H and 171L connected in parallel, 171L the circuits determining whether the voltage is greater than the preset minimum voltage, and the 171H circuit determining whether the voltage is less than a preset maximum voltage. Since the construction of circuits, 171L and 171H is the same (differing only, in the setting of the voltage reference value), only the 171L circuit need be described.

Comparator circuit 171L preferably includes an input buffer 172L having an input at 161 and an output at 175L. Buffer 172L preferably includes a voltage follower amplifier of conventional construction. Buffer 172L thus amplifies the input voltage at 161, isolating the detecting circuitry from the feedback from the logic circuits and electromechanical relays and filtering out noise from the DC signal at 161 produced by the charge-coupled precision DC rectifier of circuit 160.

Buffer 172L outputs to one input 175L of the voltage comparator 176L of conventional construction. The other input 177L of the comparator 176L is connected to the output of an adjustable voltage reference 178L. Adjustable voltage reference 178L is preferably constructed of a precision voltage reference source which is highly stable and temperature compensated and an adjustable voltage divider network so that the desired output voltage at 177L can be conveniently preset to the desired minimum voltage value during calibration. Such adjustable voltage sources are will known in the art. Comparator 176L will have an output at 179L only when the value of the input at 175L exceeds the input at 177L, that is, when the value of the voltage at 175L exceeds the predetermined preset value.

The construction of the voltage comparator circuit 171H is the same as for 171L, except that the adjustable voltage reference 178H is preset for a different, higher voltage value than 178L, and the voltage comparator 176H is connected so as to have an output at 179H when the input at 175H is less than the input at 177L. Of course, if desired, both comparator 176L and comparator 176H can utilize the same precision voltage source with separately adjustable voltage divider networks.

Outputs 179L and 179H are fed, respectively, to timers 190L and 190H. Timers 190L and 190H clock the outputs at 191L and 191H to provide a noise immunity and to make possible use of conventional downstream digital logic circuits. The clocked outputs 191L and 191H from the timers 190L and 190H (which should be timed to operate simultaneously) are coupled to the inputs of AND gate 200. Simultaneous presence of an output at 191L and 191H indicates that the voltage at 161 is between the preset maximum voltage and the preset minimum voltage. This results in an output signal at 201 corresponding to a window detect which, in turn, corresponds to the presence of a coin of a particular type at the inductor probe 151. The output signal at 201 can then be used to actuate indicating means such as a light emitting diode, or to actuate electromechanical devices to take appropriate action with respect to the coin under test, such as accepting the coin into a coin receiving hopper or rejecting the coin to coin return.

All the other window detectors operate identically, but have different preset values of maximum and minimum voltages. In the present example, eight window detectors are employed, but any number can be employed depending upon the number of coins that are desired to be discriminated.

The above-described embodiment of coin testing apparatus 10 in accordance with the present invention utilizes window detectors 170 which receive an analog input from AC to DC converter 160. The comparison with the maximum and minimum voltage levels is thus performed on an analog basis, although the output is presented in digital form. In a second embodiment of the present invention, the output signal from detector probes which detect metallic content, diameter and double-dime thickness are converted into digital form and supplied to a microprocessor-based control circuit wherein the analysis is performed digitally.

Figure 3:
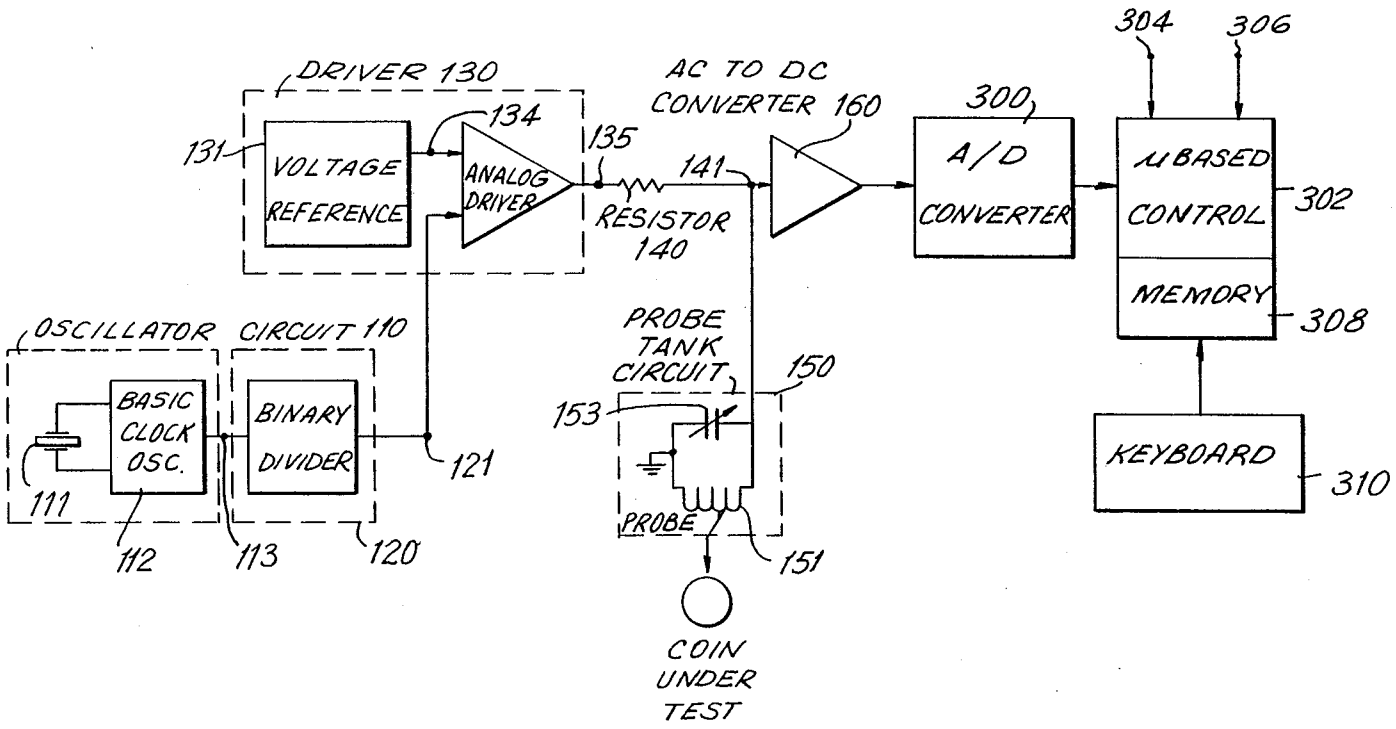
FIG. 3 is a schematic block diagram of a second preferred embodiment of the present invention, including a digital detector usable in the apparatus of FIG. 1.

As illustrated in FIG. 3, the output of AC to DC converter 160 may be supplied to an analog to digital (A/D) converter 300 wherein it is converted into a first digital signal indicative of the metallic content of the coin under test. It will be understood that any other detection probe which provides an analog signal may be used in place of the probe tank circuit 153 and associated elements to provide the signal to A/D converter 300, or that a detection probe providing a digital output signal may be directly substituted. This first digital signal is then supplied to a microprocessor-based control circuit 302, which is suitably programmed to generate an identification of the coin under test as one of the known coins, as described below.

Control circuit 302 is also connected to receive a second digital signal from a second source 304, which second digital signal is indicative of the diameter of the coin, and is further connected to receive a third digital signal from a third source 306, the third digital signal being indicative of the thickness of the coin under test. Devices which measure the diameter and thickness of a coin and provide an analog signal indicative of the respective characteristic are well known in the art and will not be described herein. The analog output signals are converted into digital form by respective analog to digital converters (not illustrated) to form the second and third digital signals. It will be understood by those of ordinary skill in the art that control circuit 302 may be programed to standardize the values of the first, second and third digital signals, regardless of the particular choice of detection probes, before identifying the coin under test.

Control circuit 302 uses the first and second digital signals and optionally the third digital signal to provide an identification of the coin under test. The identification procedure may be effected in any one of a number of ways. For example, control circuit 302 may use a coin identification algorithm in which the values of the first, second and third digital signals are inserted and the resulting computed value identifies the coin under test as one of the known coins or as an invalid coin. For example, the first digital signal may be derived from the analog signal input to A/D converter 300 such that the value of the first digital signal is, in binary, 000 for a nickel, 110 for a dime and 101 for a quarter. These values are chosen so that each value differs from the others in two positions. The second and third digital signals may similarly have the values 000 for a nickel, 110 for a dime and 101 for a quarter. The concentration of these three values provides an unique identification for each coin, that is, 000000000 for a nickel, 110110110 for a dime and 101101101 for a quarter. Any other value will indicate inconsistent values of the first, second and third digital signals, and any deviation in the repeating pattern will indicate the type of false coin. Control circuit 302 then identifies the coin as a false coin in response to such inconsistent values. Other algorithms, such as unique summing algorithms, may alternatively be used.

Figure 4:
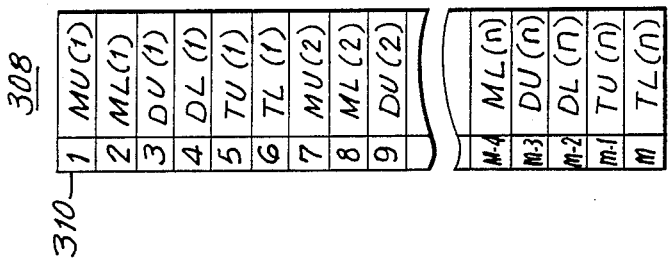
FIG. 4 is an illustration of a portion of a memory within the digital detector of FIG. 3.

Alternatively, control circuit 302 may identify the coin as being one of a plurality of known coins using a window detection based system as in the first embodiment described above. In such case, control circuit 302 includes a memory 308 in which upper and lower digital threshold values are stored, each threshold value being indicative of either metallic content, diameter or thickness of a respective one of the known coins. A portion of memory 308 is illustrated in FIG. 4. As shown therein, memory 308 includes m numbered memory locations 310 each including one of such digital threshold values for a total of n known coins. Thus, memory location 1 includes the upper threshold value MU(1) for metallic content of the first known coin and memory location 2 holds the lower threshold value ML(1) for metallic content for the first coin. Memory location 3 holds the upper threshold value DU(1) for diameter of the first coin and memory location 4 holds the lower threshold value DL(1) for diameter for the first coin. Memory location 5 holds the upper threshold value TU(1) for thickness of the first coin and memory location 6 holds the lower threshold value TL(1) for thickness of the first known coin. The remaining locations 7 m hold the upper and lower metallic, diameter and thickness threshold values for coins 2—n, as indicated in FIG. 4.

Figure 6:
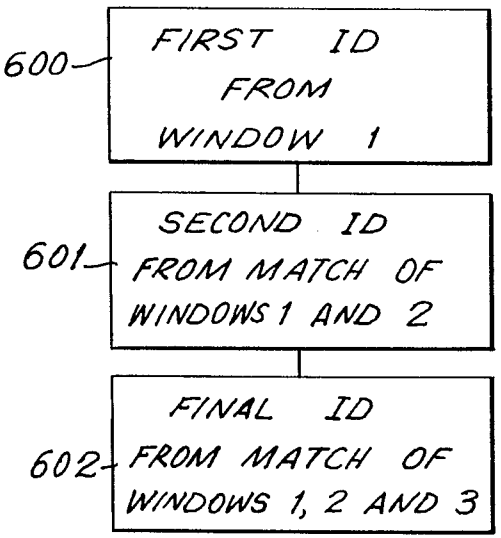
FIG. 6 is a flowchart of a second coin identification process.
Figure 5:
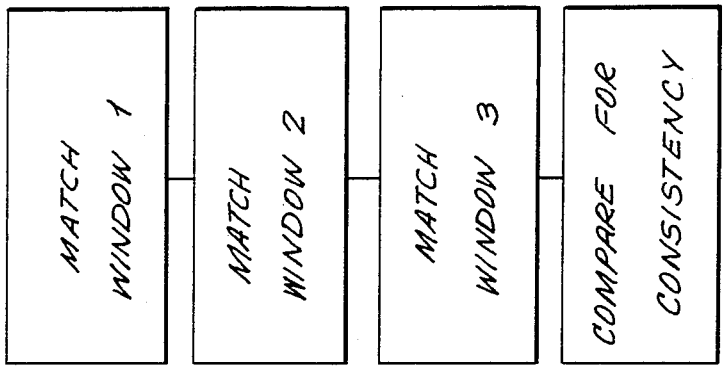
FIG. 5 is a flowchart of a first coin identification process.

The pairs of threshold values define mutually exclusive ranges or windows for the three physical characteristics of each coin. If other characteristics are to be detected, memory 308 may hold threshold values for such other characteristics. Control circuit 302 may then provide an identification of the coin under test by determining which of the windows include the values of the first, second and third digital signals for the coin under test. This may be done, for example, by determining the appropriate window for each of the three digital signals and then comparing the windows to determine if they are associated with the same known coin. This process is illustrated in the flowchart of FIG. 5. Alternatively, as illustrated in the flowchart of FIG. 6, control circuit 302 may determine in step 600 which metallic content window includes the value of the first digital signal to make a first identification of the coin, then in step 601 go to the diameter window associated with that one known coin to determine if such diameter window includes the value of the second digital signal to make a second identification of the coin, and thirdly, if the first and second identifications are consistent, control circuit 302 may then in step 602 go to the thickness window associated with the one known coin to determine if it includes the value of the third digital signal to complete the identification.

The third digital signal may be used to test for thickness directly or may be used to test for double-dime thickness. It is an acknowledged difficulty in the art of automatic toll collecting that the thinness of United States dimes can lead to misidentification of the coins when, for example, two dimes together are detected as one coin. Thus, each of the upper and lower thickness threshold levels may be indicative of double thickness of the known coins, and control circuit 302 may double the value of the third digital signal prior to its being compared to the upper and lower threshold values stored in memory 308. Furthermore, since only the dime among United States coins presents this problem, control circuit 302 may use default values for the upper and lower threshold values, or may even ignore the third digital signal once a preliminary identification has been made that the coin under test is not a dime. In such case, memory 308 need not store upper and lower thickness threshold values for these other coins.

One advantage of the digital identification of coins described above is that the threshold values stored in the memory 308 may be easily adjusted simply by storing new values for the thresholds in the appropriate memory locations. For example, if a new coin is to be added to the list of known coins, upper and lower threshold values therefor may be input to memory 308 through a keyboard 310. Keyboard 310 may also be used to adjust the threshold values already stored in memory 308 to reflect different known coins or more accurate threshold values for the known coins. In addition, control circuit 302 may have an automatic stability algorithm to ensure that the stored threshold values are not erroneously altered due to, for example, transients in the voltage supply. Control circuit 302 may, for example, keep a duplicate list of the stored threshold values to detect any changes therein, or may be programmed to detect erroneous values of the threshold values. For example, each threshold value may be predetermined as an even value, so that the presence of an odd threshold value would indicate an error. Control circuit 302 may then be programmed to adjust such erroneous threshold values to their proper values or to give an error indication.

Figure 7:
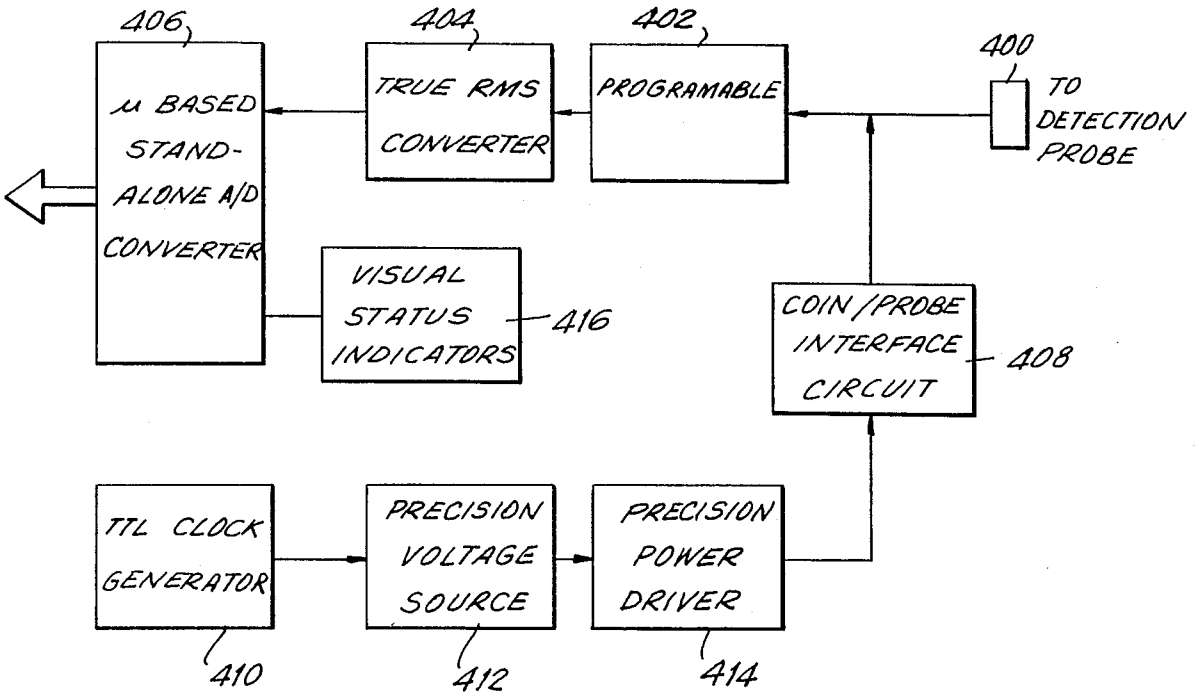
FIG. 7 is a block diagram of the support circuitry for the digital detector of FIG. 3.

A more detailed configuration for the support circuitry is illustrated in FIG. 7. As shown therein, the AC signal from probe tank circuit 150 illustrated in FIG. 2 is provided at source 400. It will be understood that the AC signals indicative of diameter and thickness are similarly provided at respective sources, and that the apparatus includes corresponding support circuitry for these other signals. The AC metallic content signal is supplied from source 400 through a programmable gain amplifier 402 to a true rms converter 404, wherein it is converted into a DC signal. The DC signal is then supplied to a microprocessor-based stand alone analog to digital converter 406, wherein it is transformed into the first digital signal indicative of the metallic content of the coin. A coin/probe interface circuit 408 is provided to control the generation of the AC signal in a known and precise fashion. To this end, a TTL clock generator 410 provides clocking signals to a precision voltage source 412, which in turn provides known, controlled voltage signals to precision power driver 414 connected to coin/probe interface circuit 408. A/D converter 406 has a plurality of visual status indicators 416 associated therewith to provide visual indications when the system is receiving input signals within an acceptable range of values. The output of A/D converter 406 is then provided to the microprocessor-based control circuit 302. It will be understood by those skilled in the art that a single microprocessor may alternatively be used to control both control circuit 302 and A/D converter 406.

As can be seen, the present invention provides a counterfeit coin detecting circuit which is simple, robust, highly independent of environmental temperature changes and thus well adapted to operate in an outdoor or other harsh environment. The terms which have been used herein are terms of expression only to describe preferred embodiments of the present invention and not of limitation. There is no intention in the use of such terms to exclude any equivalents of the present invention, which is defined by the appended claims.

What is claimed is:

1. Apparatus for testing a coin having a metallic content, diameter and a thickness comprising:

a first source of a first digital signal having a value indicative of a metallic content of a coin;

a second source of a second digital signal having a value indicative of a diameter of said coin;

a third source of a third digital signal having a value indicative of a thickness of said coin;

microprocessor-based control means for identifying said coin as being one of a plurality of known coins in response to said first, second and third digital signals, said control means including memory means for storing a plurality of digital threshold values each said threshold value being respectively indicative of a selected one of metallic content, diameter and thickness of a respective one of said known coins, said control means further including means for comparing said first, second and third digital signals to corresponding ones of said stored threshold values respectively indicative of metallic content, diameter and thickness for identifying said coin;

said memory means storing upper and lower digital threshold values indicative of metallic content for each of said known coins and defining first mutually exclusive ranges for said known coins, and said comparing means determining which of said ranges includes said value of said first digital signal;

said memory means storing upper and lower digital threshold values indicative of diameter for each of said known coins and defining second mutually exclusive ranges for said known coins, said comparing means determining which of said second ranges includes said value of said second digital signal, and said control means determining whether the first and second ranges including the values of said first and second digital signals, respectively, correspond to the same known coin;

said memory means storing upper and lower digital threshold values indicative of double thickness defining a third range for at least a predetermined one of said known coins, said control means determining whether said same known coin is the predetermined known coin, and said comparing means determining whether twice the value of said third digital signal is included in the third range for said known coin; and input means for inputting said threshold values for storage in said memory means.

2. Apparatus for testing a coin having a metallic content, a diameter and a thickness comprising:

a first source of a first digital signal having a value indicative of a metallic content of a coin;

a second source of a second digital signal having a value indicative of a diameter of said coin;

a third source of a third digital signal having a value indicative of a thickness of said coin; and microprocessor-based control means for identifying said coin as being one of a plurality of known coins in response to said first, second and third digital signals, said control means generating a first identification of said coin in response to said first digital signal, a second identification of said coin in response to said first identification and a selected one of said second and third digital signals, and a third identification of said coin in response to said second identification and the other of said second and third digital signals.

3. Apparatus according to claim 2, in which said second identification is generated in response to said first identification and said second digital signal.

4. Apparatus according to claim 2, wherein said second identification is generated in response to said first identification and said third digital signal.

5. Apparatus for testing a coin having a metallic content, a diameter and a thickness comprising:

a first source of a first digital signal having a value indicative of a metallic content of a coin;

a second source of a second digital signal having a value indicative of a diameter of said coin;

a third source of a third digital signal having a value indicative of a thickness of said coin; and microprocessor-based control means for identifying said coin as being one of a plurality of known coins in response to said first, second and third digital signals, said control means including memory means for storing a plurality of digital windows each being respectively indicative of a range of metallic content values for a respective one of said known coins, said control means further including means for determining which of said windows includes the value of said first digital signal.

6. Apparatus according to claim 5, wherein said control means includes memory means for storing a plurality of digital threshold values, each said threshold value being respectively indicative of a selected one of metallic content, diameter and thickness of a respective one of said known coins, said control means further including means for comparing said first, second and third digital signals to corresponding ones of said stored threshold values respectively indicative of metallic content, diameter and thickness for identifying said coin.

7. Apparatus according to claim 6, further comprising input means for inputting said threshold values for storage in said memory means.

8. Apparatus according to claim 7, wherein said memory means stores upper and lower digital threshold values indicative of metallic content for each of said known coins and defining mutually exclusive ranges for said known coins, and wherein said comparing means determines which of said ranges includes said value of said first digital signal.

9. Apparatus according to claim 12, wherein said first source includes circuit means for generating an analog signal indicative of said detected metallic content and analog-to-digital converter means converting said analog signal into said first digital signal.

10. Apparatus according to claim 5, wherein said memory means stores a plurality of second digital windows each being respectively indicative of a range of diameters associated with a respective one of said known coins and associated with a respective one of the first-mentioned windows, and said determining means further determinants whether said value of said second digital signal fall within the second window associated with the determined first window.

11. Apparatus according to claim 10, wherein one of said known coins is a dime and wherein said memory further stores a third digital window indicative of a double-dime thickness, responsive to a determination that said values of said first and second signals fall within the first and second windows associated with a dime, respectively, for determining whether said value of said third digital signal falls within said third window.

12. Apparatus according to claim 5, wherein said control means further identifies said coin as a false coin in response to inconsistent values of said first, second and third digital signals.

13. Apparatus according to claim 5, wherein said control means includes memory means for storing digital data used in identifying said coin, and means for adjusting the digital data stored in said memory means.

14. Apparatus according to claim 13, wherein the adjusting means includes input means for inputting said digital data for storage in said memory means.

15. Apparatus for testing a coin having a metallic content, diameter and a thickness comprising:

a first source of a first digital signal having a value indicative of a metallic content of a coin;

a second source of a second digital signal having a value indicative of a diameter of said coin;

a third source of a third digital signal having a value indicative of a thickness of said coin;

microprocessor-based control means for identifying said coin as being one of a plurality of known coins in response to said first, second and third digital signals, said control means including memory means for storing a plurality of digital threshold values, each said threshold value being respectively indicative of a selected one of metallic content, diameter and thickness of a respective one of said known coins, said control means further including means for comparing said first, second and third digital signals to corresponding ones of said stored threshold values respectively indicative of metallic content, diameter and thickness for identifying said coin;

said memory means storing upper and lower digital threshold values indicative of metallic content for each of said known coins and defining first mutually exclusive ranges for said known coins, and said comparing means determining which of said ranges includes said value of said first digital signal;

said memory means storing upper and lower digital threshold values indicative of diameter for each of said known coins and defining second mutually exclusive ranges for said known coins, said comparing means determining which of said second ranges includes said value of said second digital signal, and said control means determining whether the first and second ranges including the values of said first and second digital signals, respectively, correspond to the same known coin; and input means for inputting said threshold values for storage in said memory means.

* * * * *